US010470489B2

(12) United States Patent
Herve et al.

(10) Patent No.: US 10,470,489 B2
(45) Date of Patent: Nov. 12, 2019

(54) SMOKING ARTICLES HAVING REDUCED IGNITION PROCLIVITY CHARACTERISTICS

(71) Applicant: Schweitzer-Mauduit International, Inc., Alpharetta, GA (US)

(72) Inventors: Raoul Herve, Lorient (FR); Julia Cloitre-Chabert, Montmorancy (FR); Patrick Guilchet, Quimperle (FR); Thomas A. Kraker, Alpharetta, GA (US)

(73) Assignee: Schweitzer-Maudult International, Inc., Alpharetta, GA (US)

( * ) Notice: Subject to any disclaimer, the term of this patent is extended or adjusted under 35 U.S.C. 154(b) by 1113 days.

(21) Appl. No.: 14/099,305

(22) Filed: Dec. 6, 2013

(65) Prior Publication Data

US 2014/0090656 A1 Apr. 3, 2014

Related U.S. Application Data

(62) Division of application No. 12/167,615, filed on Jul. 3, 2008.

(Continued)

(51) Int. Cl.
*A24D 1/02* (2006.01)
*D21H 19/36* (2006.01)

(Continued)

(52) U.S. Cl.
CPC ..... *A24D 1/025* (2013.01); *D21H 19/36* (2013.01); *D21H 17/15* (2013.01); *D21H 17/28* (2013.01); *D21H 17/38* (2013.01)

(58) Field of Classification Search
None
See application file for complete search history.

(56) References Cited

U.S. PATENT DOCUMENTS 1,996,002 A 5/1933 Seaman
2,013,508 A 5/1933 Seaman (Continued)

FOREIGN PATENT DOCUMENTS

EA 200300913 2/2004
EP 0262550 A1 4/1988

(Continued)

OTHER PUBLICATIONS

Pulp And Paper Chemistry and Chemical Technology, Third Edition, vol. III by James P. Casey—Editor—A Wiley-Interscience Publication—pp. 1507-1521 & pp. 1702-1703.

(Continued)

*Primary Examiner* — Michael J Felton
(74) *Attorney, Agent, or Firm* — Dority & Manning, P.A.

(57) ABSTRACT

Smoking articles having reduced ignition proclivity characteristics are disclosed. The smoking articles include a paper wrapper containing cellulosic fibers and filler particles. The paper wrappers are treated with a film-forming composition in order to reduce the ignition proclivity characteristics of the smoking articles. In one embodiment, the film-forming composition contains an alginate combined with a starch. In an alternative embodiment, the film-forming composition contains a film-forming material combined with filler particles. The filler particles may comprise kaolin clay, magnesium oxide, mica, alum, or mixtures thereof.

25 Claims, 7 Drawing Sheets

Related U.S. Application Data

(60) Provisional application No. 60/958,263, filed on Jul. 3, 2007.

(51) Int. Cl.

| | |
|---|---|
| *D21H 17/15* | (2006.01) |
| *D21H 17/28* | (2006.01) |
| *D21H 17/38* | (2006.01) |

(56) References Cited

U.S. PATENT DOCUMENTS

| | | | |
|---|---|---|---|
| 2,776,912 | A | 1/1957 | Gregory |
| 3,215,579 | A | 11/1965 | Hagen |
| 3,351,479 | A | 11/1967 | Fairchild |
| 3,511,247 | A | 5/1970 | Tamol |
| 3,526,904 | A | 9/1970 | Tamol |
| 3,620,801 | A | 11/1971 | O'Grady |
| 3,699,973 | A | 10/1972 | Tamol et al. |
| 3,736,940 | A | 6/1973 | Saint-Pastou |
| 3,911,932 | A | 10/1975 | Houck, Jr. et al. |
| 3,949,762 | A | 4/1976 | West et al. |
| 4,077,414 | A | 3/1978 | Baker et al. |
| 4,129,134 | A | 12/1978 | Hind et al. |
| 4,146,040 | A | 3/1979 | Cohn |
| 4,222,740 | A | 9/1980 | Bohrn et al. |
| 4,267,240 | A | 5/1981 | Jaisle et al. |
| 4,303,084 | A | 12/1981 | Simon |
| 4,452,259 | A | 6/1984 | Norman et al. |
| 4,590,955 | A | 5/1986 | Dixit |
| 4,607,647 | A | 8/1986 | Dashley et al. |
| 4,615,345 | A | 10/1986 | Durocher |
| 4,622,983 | A | 11/1986 | Matthews et al. |
| 4,679,575 | A | 7/1987 | Yamaguchi et al. |
| 4,739,775 | A | 4/1988 | Hampl, Jr. |
| 4,784,164 | A | 11/1988 | Adams et al. |
| 4,805,644 | A | 2/1989 | Hampl, Jr. |
| 4,889,145 | A | 12/1989 | Adams et al. |
| 4,945,932 | A | 8/1990 | Mentzel et al. |
| 4,984,589 | A | 1/1991 | Riedesser |
| 4,998,542 | A | 3/1991 | Kallianos et al. |
| 5,057,606 | A | 10/1991 | Garbe |
| 5,092,353 | A | 3/1992 | Montoya et al. |
| 5,125,421 | A | 6/1992 | Mitchell |
| 5,131,416 | A | 7/1992 | Gentry |
| 5,144,966 | A | 9/1992 | Washington |
| 5,170,807 | A | 12/1992 | Kasbo et al. |
| 5,178,167 | A | 1/1993 | Riggs et al. |
| 5,221,502 | A | 6/1993 | Washington |
| 5,261,425 | A | 11/1993 | Raker et al. |
| 5,263,999 | A | 11/1993 | Baldwin et al. |
| 5,271,419 | A | 12/1993 | Arzonico et al. |
| 5,417,228 | A | 5/1995 | Baldwin et al. |
| 5,474,095 | A | 12/1995 | Allen et al. |
| 5,540,242 | A | 7/1996 | Chao et al. |
| 5,690,787 | A | 11/1997 | Hultman et al. |
| 5,722,433 | A | 3/1998 | Ishino et al. |
| 5,820,998 | A | 10/1998 | Hotaling et al. |
| 5,849,153 | A | 12/1998 | Ishino et al. |
| 5,878,753 | A | 3/1999 | Peterson et al. |
| 5,878,754 | A | 3/1999 | Peterson et al. |
| 6,129,087 | A | 10/2000 | Wallace et al. |
| 6,568,403 | B2 | 5/2003 | Hampl, Jr. et al. |
| 6,606,999 | B2 | 8/2003 | Crooks et al. |
| 6,645,605 | B2 | 11/2003 | Hammersmith et al. |
| 6,725,867 | B2 | 4/2004 | Peterson et al. |
| 6,779,530 | B2 | 8/2004 | Kraker |
| 6,837,248 | B2 | 1/2005 | Zawadzki et al. |
| 6,854,469 | B1 | 2/2005 | Hancock et al. |
| 6,929,013 | B2 | 8/2005 | Ashcraft et al. |
| 7,600,518 | B2 | 10/2009 | Oglesby et al. |
| 2002/0139381 | A1 | 10/2002 | Peterson et al. |
| 2002/0179105 | A1 | 12/2002 | Zawadzki et al. |
| 2002/0179106 | A1 | 12/2002 | Zawadzki et al. |
| 2003/0131860 | A1 | 7/2003 | Ashcraft |
| 2003/0164173 | A1 | 9/2003 | Zawadzki et al. |
| 2004/0011368 | A1 | 1/2004 | Tsutsumi et al. |
| 2004/0020502 | A1 | 2/2004 | Tosas Fuentes et al. |
| 2004/0123874 | A1 | 7/2004 | Zawadzki et al. |
| 2004/0182407 | A1 | 9/2004 | Peterson et al. |
| 2007/0084475 | A1 | 4/2007 | Oglesby |
| 2007/0137668 | A1 | 6/2007 | Borschke et al. |
| 2007/0246055 | A1 | 10/2007 | Oglesby |
| 2007/0251658 | A1 | 11/2007 | Gedevanishvili et al. |
| 2008/0115794 | A1 | 5/2008 | Oglesby |

FOREIGN PATENT DOCUMENTS

| | | | |
|---|---|---|---|
| EP | 0193607 | B1 | 1/1989 |
| EP | 0386884 | A2 | 9/1990 |
| EP | 0758532 | A | 2/1997 |
| EP | 0864259 | A2 | 9/1998 |
| GB | 848332 | | 8/1956 |
| RU | 2198742 | | 2/2003 |
| WO | WO 88/01478 | A | 3/1998 |
| WO | WO 02/067704 | | 9/2002 |
| WO | WO 02/078471 | | 10/2002 |

OTHER PUBLICATIONS

Kimberly-Clark, Product List of Cigarette Papers, 5 pages (Nov. 3, 1993).

Ecusta, Standard Products Catalog of Cigarette papers, 3 pages (Apr. 15, 1987).

Publication, "Relative Ignition Propensity of Test Market Cigarettes", Richard G. Gann, et al., National Institute of Standards and Technology, Technology Administration, U.S. Department of Commerce, Jan. 2001.

Publication, "The Effect of Cigarette Characteristics on the Ignition of Soft Furnishings", Richard G. Gann, et al., Center for Fire Research National Bureau of Standards, Oct. 1987.

Publication, "Overview: Practicability of Developing a Performance Standard to Reduce Cigarette Ignition Propensity", U.S. Consumer Product Safety Commission, Aug. 1993.

Publication, "Werkstoffe der Papierverarbeitung", Lehmann et al., Deutscher Fachverlag, Gmbh, Frankfurt (Main), 1979, pp. 110-115 (XP002529473).

Publication, "Rauigkeit als vernachlassigte Einflussgrosse der Druckqualitat", Steiger et al., Ugra Mitteilungen, (online) 2004, p. 34 (XP001418472).

Publication, "Determination of paper filler Z-distribution by low-vacuum SEM and EDX" Roux et al., Journal of Microscopy, (online) vol. 229, No. 1, Dec. 17, 2007, abstract.

Publication, "Determination of Paper Filler Z-distribution by Low Vacuum SEM and EDX", Roux et al., Journal of Microscopy, (online) vol. 229, No. 1, Dec. 17, 2007, pp. 44-45.

International Search Report PCT/US2007/012955, completed Oct. 23, 2007, dated Oct. 30, 2007.

International Search Report PCT/US2009/033188, completed Feb. 5, 2009, dated Aug. 28, 2009.

International Search Report PCT/US2008/069149, completed Jul. 3, 2008, dated Jan. 5, 2009.

International Search Report PCT/US2008/069149, completed Jul. 3, 2008, dated May 14, 2009.

SMOKING ARTICLES HAVING REDUCED IGNITION PROCLIVITY CHARACTERISTICS

RELATED APPLICATION DATA

The present application is based on and claims priority to U.S. patent application Ser. No. 12/167,615, filed on Jul. 3, 2008, and claims priority to U.S. Provisional Patent Application Ser. No. 60/958,263, filed on Jul. 3, 2007, which are all incorporated herein by reference in their entirety.

BACKGROUND

There is an ongoing concern in the tobacco industry to produce cigarettes having wrappers which reduce the ignition proclivity of the smoking article, or the tendency of the smoking article to ignite surfaces which come into contact with the lit smoking article. Reports have been made of fires attributed to burning cigarettes coming into contact with combustible materials. A justifiable interest exists in the industry to reduce the tendency of cigarettes, or other smoking articles to ignite surfaces and materials used in furniture, bedding, and the like upon contact.

Thus, a desirable feature of smoking articles, particularly cigarettes, is that they self-extinguish upon being dropped or left in a free burning state in contact with combustible materials.

It has long been recognized in the tobacco industry that the cigarette wrapper has a significant influence on the smolder characteristics of the cigarette. In this regard, various attempts have been made in the art to alter or modify the cigarette wrappers in order to achieve the desired tendency of the cigarette to self-extinguish, or in other words to reduce the ignition proclivity characteristics of cigarettes.

The prior art describes the application of film-forming solutions to cigarette paper to reduce the paper permeability and control the burn rate. It has been shown that when these materials have been applied in discrete areas along the length of the cigarette, the cigarette shows a reduced propensity to ignite a substrate, and tends to self-extinguish.

U.S. Pat. No. 5,878,753 to Peterson and U.S. Pat. No. 5,820,998 to Hotaling, et al, which are incorporated herein by reference, for example, describe a smoking article wrapper being treated with a film-forming aqueous solution to reduce permeability. U.S. Pat. No. 5,878,754 to Peterson which is also incorporated herein by reference describes a smoking article wrapper being treated with a non-aqueous solution of a solvent soluble polymer dissolved in a non-aqueous solution to reduce permeability.

The present application is directed to further improvements in producing a wrapper for a smoking article with reduced ignition proclivity properties. In particular, the present disclosure is directed to improved formulations that may be applied to the paper wrapper.

SUMMARY

The present disclosure is generally directed to paper wrappers for smoking articles with reduced ignition proclivity and to a process for making the wrappers. For example, in one embodiment, the paper wrapper can be made from a paper web. For example, the paper wrapper can contain flax fibers, softwood fibers, hardwood fibers and mixtures thereof. The paper wrapper can also include a filler, such as calcium carbonate and/or a magnesium oxide, in an amount from about 10% to about 40% by weight.

A film-forming composition is applied to the paper wrapper at particular locations. The film-forming composition forms treated discrete areas on the wrapper. The discrete areas are separated by untreated areas. The treated discrete areas are configured to reduce ignition proclivity of a smoking article incorporating the wrapper. For example, the treated areas can reduce ignition proclivity by reducing oxygen to a smoldering coal of the smoking article as the coal burns and advances into the treated areas.

In one embodiment of the present disclosure, the film-forming composition comprises the combination of a film-forming material, which may itself be a polysaccharide, and a polysaccharide, such as a starch, which may also be considered a film-forming material. It has been unexpectedly discovered that combining a film-forming material with a starch produces synergistic results. In particular, a film-forming composition containing both a film-forming material and a starch has been found to be more efficient at reducing the ignition proclivity characteristics of a smoking article in comparison to a film-forming composition containing a film-forming material alone or a film-forming composition containing a starch alone.

The film-forming material combined with the starch in accordance with the present disclosure can vary depending upon the particular application. Film-forming materials that may be used include, for instance, guar gum, pectin, polyvinyl alcohol, polyvinyl acetate, cellulose, cellulose derivatives such as ethyl cellulose, methyl cellulose, hydroxypropyl cellulose, hydroxyethyl cellulose, carboxymethyl cellulose, and the like, alginates, and mixtures thereof. In one particular embodiment, for instance, a starch may be combined with an alginate in forming the composition.

The relative amounts of the starch and film-forming material, such as alginate, within the film-forming composition may vary depending upon the particular application. In one embodiment, for instance, the film-forming material may be present within the film-forming composition after being applied and dried on a paper wrapper in an amount from about 1% to about 15% by weight of the treated areas. Starch, on the other hand, may be present in the treated areas in an amount from about 1% to about 20% by weight of the treated areas.

In another embodiment of the present disclosure, the film-forming composition contains a film-forming material combined with specific filler particles. The filler particles may comprise, for instance, magnesium oxide, mica, kaolin clay, or mixtures thereof. In the past, those skilled in the art have suggested combining a film-forming material with various particulate inorganic fillers. The present inventors have discovered, however, that the above fillers are unexpectedly more efficient at reducing the ignition proclivity properties of a treated paper wrapper in comparison to the particulate inorganic fillers used in the past.

The above listed filler particles may be contained in the film-forming composition (as applied to the wrapper) in an amount from about 0.25% to about 15% by weight of the composition, such as from about 0.5% to about 5% by weight of the composition. The filler particles can have an average diameter from about 0.0001 microns to about 5 microns, such as from about 0.1 microns to about 3 microns.

The film-forming material combined with the filler particles can be any suitable film-forming material such as an alginate. In an alternative embodiment, the filler particles can be combined with a starch. In still another embodiment, the filler particles may be combined with a film-forming composition containing both an alginate and a starch.

Other film-forming materials that may be used solely or in combination with the filler particles include guar gum, pectin, polyvinyl alcohol, polyvinyl acetate, cellulose and cellulose derivatives such as ethyl cellulose, methyl cellulose, hydroxypropyl cellulose, hydroxyethyl cellulose, carboxymethyl cellulose, and the like.

The film-forming composition made according to the present disclosure can be applied to the paper wrapper according to various methods. For example, the composition can be printed onto the paper using, for instance, flexography, direct gravure printing, and offset gravure printing.

In one embodiment, the discrete areas formed by the film-forming composition are in the shape of circumferential bands disposed longitudinally along the smoking article. The bands can have a width of greater than about 3 mm, such as from about 4 mm to about 10 mm. The bands can be spaced from each other at a distance of from about 5 mm to about 50 mm and particularly from about 10 mm to about 40 mm.

The amount of the film-forming composition that is applied to the paper wrapper depends upon the particular application and various factors. For example, the film-forming composition can be applied to the wrapper in an amount from about 1% to about 30% by dry weight based upon the weight of the wrapper within the treated areas, and particularly in an amount from about 2% to about 20% by dry weight.

Once applied to the paper wrapper, the treated areas can have a permeability of less than about 40 Coresta, particularly less than about 30 Coresta, and more particularly from about 1 Coresta to about 30 Coresta. The initial permeability of the paper wrapper can be from about 20 Coresta to about 150 Coresta or greater. For example, in one embodiment, the initial permeability of the paper wrapper may be greater than about 60 Coresta, such as greater than about 80 Coresta. In an alternative embodiment, the initial permeability of the paper wrapper may be less than about 60 Coresta, such as from about 20 Coresta to about 40 Coresta.

The film-forming composition when applied to the paper wrapper may be contained in an aqueous solution or may be contained in a non-aqueous solution. When contained in a non-aqueous solution, for example, an alcohol may be present.

The paper wrapper may have any suitable basis weight depending upon a particular application. In one particular embodiment, for instance, the paper wrapper may have a basis weight of from about 18 gsm to about 60 gsm. The paper wrapper may also be treated with a burn promoting agent over substantially the entire surface area of the paper wrapper. For example, the burn promoting agent may be applied to the paper wrapper prior to or after the treated areas are formed. The burn promoting agent may be applied to the paper wrapper in amounts from about 0.1% to about 8% by dry weight. The burn promoting agent may be, for instance, an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, or mixtures thereof. In one particular embodiment, the burn promoting agent is a citrate, a succinate, or mixtures thereof.

Other features and aspects of the present disclosure are discussed in greater detail below.

BRIEF DESCRIPTION OF THE DRAWINGS

A full and enabling disclosure of the present disclosure, including the best mode thereof to one of ordinary skill in the art, is set forth more particularly in the remainder of the specification, including reference to the accompanying figures in which.

Figure 1:
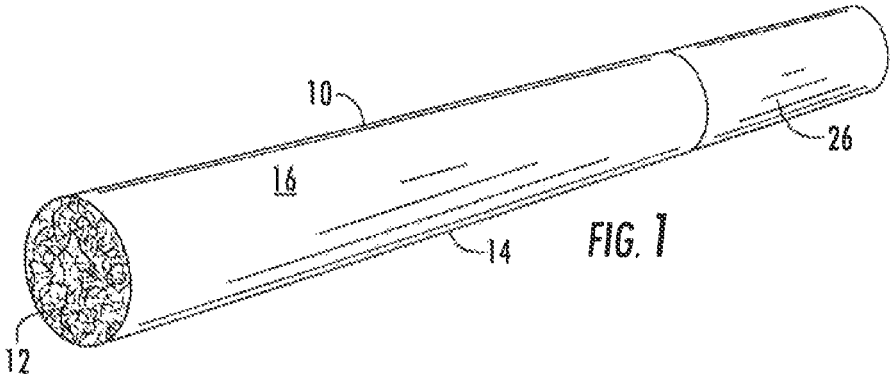
FIG. 1 is a perspective view of a smoking article made in accordance with the present disclosure.

Repeat use of reference characters in the present specification and drawings is intended to represent same or analogous features or elements of the present disclosure.

DETAILED DESCRIPTION

Reference now will be made in detail to the embodiments of the disclosure, one or more examples of which are set forth below. Each example is provided by way of explanation of the invention, not limitation of the invention. In fact, it will be apparent to those skilled in the art that various modifications and variations can be made in the present invention without departing from the scope or spirit of the disclosure. For instance, features illustrated or described as part of one embodiment, can be used on another embodiment to yield a still further embodiment. Thus, it is intended that the present invention cover such modifications and variations.

For purposes of explanation of the disclosure, the embodiments and principles of the disclosure will be discussed in regards to a cigarette. However, this is for the purposes of explanation of the disclosure only and is not meant to limit the disclosure only to cigarettes. Any manner of smoking article is within the scope and spirit of the disclosure.

The present disclosure relates to a smoking article and a wrapper for a smoking article having improved ignition proclivity control characteristics. "Ignition proclivity" is a measure of the tendency of the smoking article or cigarette to ignite a flammable substrate if the burning cigarette is dropped or otherwise left on a flammable substrate, A test for ignition proclivity of a cigarette has been established by NIST (National Institute of Standards and Technology) and is generally referred to as the "Mock-Up Ignition Test". The test comprises placing a smoldering cigarette on a flammable test fabric and recording the tendency of the cigarette to either ignite the test fabric, burn the test fabric beyond a normal char line of the fabric, burn its entire length without igniting the fabric, or self-extinguish before igniting the test fabric or burning its entire length.

Another test for ignition proclivity is referred to as the "Cigarette Extinction Test". The Cigarette Extinction Test is ASTM Test No. E2187-04. In the Cigarette Extinction Test, a lit cigarette is placed on one or more layers of filter paper. If the cigarette self extinguishes, the cigarette passes the test. If the cigarette burns all the way to its end on the filter, however, the cigarette fails. Smoking articles made in accordance with the present invention can be designed to pass one or both of these tests.

In addition to the above tests, smoking articles having reduced ignition proclivity cigarettes are typically also tested for "free air self-extinguishment" (FASE). During the free air extinguishment test, the smoking articles are allowed to burn in the free air without being puffed and without being placed on an adjacent surface. In some applications, it is desirable for a smoking article to pass the mock up ignition test or the cigarette extinction test while not self-extinguishing when left burning in the free air. Thus, lower FASE rates may be preferred. Of particular advantage, smoking articles constructed in accordance with the principles of the present disclosure may be configured to self extinguish when placed on an adjacent surface but yet have lower FASE rates in comparison to many prior products that are intended to have reduced ignition proclivity characteristics.

In general, smoking articles having reduced ignition proclivity are made according to the present disclosure by applying in discrete areas to a wrapping paper a film-forming composition. In one embodiment, the film-forming composition contains a film-forming material combined with a polysaccharide. The film-forming material may comprise, for instance, an alginate, guar gum, pectin, polyvinyl alcohol, polyvinyl acetate, cellulose, a cellulose derivative, or mixtures thereof. The polysaccharide may comprise, for instance, a starch. The starch may be a natural starch or may be a modified starch. The present inventors have discovered that when a polysaccharide and a film-forming material are combined together, various synergistic advantages and benefits are obtained.

In the past, the assignee of the present application has obtained various patents directed to smoking articles with reduced ignition proclivity characteristics. For example, paper wrappers treated with a film-forming composition that forms treated discrete areas on the wrapper are disclosed in U.S. Pat. Nos. 5,878,753; 5,878,754; 6,568,403; 6,779,530 and 6,725,867, which are incorporated herein by reference. The above patents disclose various different film-forming materials that may be used to form the treated discrete areas. In particular, the above patents disclose the use of alginate and disclose the use of starch. The present inventors, however, have found that various unexpected benefits and advantages are obtained when starch and a film-forming material such as an alginate are combined together.

For instance, although the rheology of starch and alginate are different, it has been discovered that the rheology of the two components are complimentary. When starch and alginate are combined, for instance, the resulting solution has improved printability.

The combination of a film-forming material such as an alginate and starch has also provided various efficiency improvements in the ability of the solution to form treated areas on paper wrappers that reduce the ignition proclivity characteristics of a smoking article incorporating the wrapper. In particular, on a weight basis, an alginate and starch solution is generally more efficient in lowering the permeability and diffusion capacity of the paper wrapper in comparison to a similar solution containing only starch or only alginate.

Although any film-forming material may be used in the composition in accordance with the present disclosure, in one embodiment, the film-forming material comprises an alginate. In general, an alginate is a derivative of an acidic polysaccaride or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

Any suitable alginate may be used in the present disclosure, including any suitable derivatives. The alginate contained in the film-forming composition, for instance, may have a relatively high molecular weight or may have a relatively low molecular weight. For example, in one embodiment, the alginate may have a viscosity of less than about 500 cP when contained in a 3% by weight aqueous solution at 25° C.

In one embodiment, for instance, KELGIN LB alginate from ISP Corporation may be used. KELGIN LB alginate is a low viscosity, pure sodium alginate.

The polysaccharide that is combined with the alginate in accordance with the present disclosure may also vary depending upon the particular application. When using a starch, the starch, for instance, may be modified or may be unmodified and may be obtained from various plants. In one embodiment, for instance, an oxidized corn starch may be combined with the alginate. One example of a commercially available oxidized corn starch is FLOKOTE 64 commercially available from the National Starch and Chemical Company of Bridgewater, N.J.

When formulated into a film-forming composition and applied to a paper wrapper in accordance with the present disclosure, the film-forming material and polysaccharide can be combined with water or with any suitable solvent. For instance, in one embodiment, the film-forming composition may comprise an aqueous dispersion or an aqueous solution. Alternatively, the film-forming composition prior to being applied to the paper wrapper may comprise a non-aqueous solution or dispersion. For instance, an alcohol may be present and combined with the film-forming material and polysaccharide.

The amount of the film-forming material and polysaccharide present within the film-forming composition may depend upon various factors. When formulating an aqueous solution or dispersion, for instance, the film-forming material such as an alginate may be present in the film-forming composition in an amount from about 1% to about 15% by weight of the solution, such as from about 1% to about 10% by weight of the solution. For instance, in one embodiment, alginate may be present in an amount from about 1% to about 10% by weight of the solution. Starch, on the other hand, may be present in an amount from about 3% to about 25% by weight of the solution, such as from about 3% to about 20% by weight of the solution. For instance, in one embodiment, starch may be present in the film-forming composition in an amount from about 3% to about 15% by weight of the solution.

It should be understood that the above percentages are merely exemplary. When printing the film-forming composition onto a paper wrapper containing a film-forming material and polysaccharide, the film-forming material and polysaccharide can be contained in the composition in amounts sufficient so that the composition has rheological properties that make the composition amenable to a printing process. For instance, the relative amounts of film-forming material and polysaccharide can be present in the composition so that the composition has a viscosity of less than about 1500 cps.

Although unknown, it is believed that when a film-forming material and a polysaccharide are combined together, both components form a film on the surface of the paper that is well suited to extinguishing a smoking article should the article be left on an adjacent surface. Although unknown, it is believed that the film-forming material is better suited to forming a film on the wrapper while the polysaccharide maintains a lower viscosity and improves the properties of the treated areas. Once applied to the paper wrapper and dried, the treated areas may contain, in one embodiment, a greater amount of polysaccharide than film-forming material. In other embodiments, however, the polysaccharide and the film-forming material may be present in equal amounts or a greater amount of the film-forming material may be present. In general, for instance, the treated areas may contain a polysaccharide from about 1% to about 20% by dry weight of the treated area, while containing the film-forming material in an amount from about 1% to about 15% by dry weight of the treated area.

In an alternative embodiment of the present disclosure, the film-forming composition applied to the paper wrapper contains a film-forming material combined with filler particles. Specifically, the present inventors have discovered that certain filler particles provide unexpected advantages in improving the ignition proclivity characteristics of the wrapper in comparison to filler particles that have been proposed in the past. Specifically, in this embodiment of the present disclosure, the film-forming composition can contain magnesium oxide particles, kaolin clay particles, mica particles, or mixtures thereof.

In the past, such as in U.S. Pat. No. 6,725,867, those skilled in the art have proposed to combine a particulate filler into a composition used to form treated areas on a cigarette wrapping paper. In the '867 patent, for instance, the particulate filler is described as being chalk, clay, calcium carbonate or titanium oxide. The present inventors, however, have discovered that the above listed particles, as shown in the examples below, demonstrate unexpectedly superior results in comparison to the fillers listed in the '867 patent.

The magnesium oxide, mica, or kaolin clay may be present in the film-forming composition, for instance, in an amount less than about 15% by weight, such as from about 0.25% to about 15% by weight, and particularly, from about 0.5% to about 5% by weight. In many applications, for instance, the particles can be present in an amount from about 1% to about 3% by weight of the composition.

The size of the filler particles may vary depending upon the particular material used in the particular application. In general, the filler particles have an average diameter of less than about 5 microns. For instance, the average size of the particles may be from about 0.0001 microns to about 5 microns, such as from about 0.1 microns to about 3 microns. The shape of the particles may also vary. For instance, in one embodiment, kaolin clay particles may be used that have a plate-like shape.

As described above, in one embodiment, the filler particles comprise magnesium oxide particles. Although the reason is unknown, magnesium oxide particles provide superior results in comparison to many other filler particles. In particular, magnesium oxide particles have the ability to efficiently reduce the ignition proclivity properties of a smoking article containing a treated wrapper.

In general, any suitable magnesium oxide particles may be used in the film-forming composition. Magnesium oxide particles, for instance, are available from numerous commercial sources. For instance, in one embodiment, magnesium oxide particles may be used that are commercially available from Additek S.A.S. under the name Magnesium Oxide Super Leger Type 04. Magnesium oxide particles well suited for use in the present disclosure are also obtainable from Scora S.A. under the name Light Magnesium Oxide "I". The Light Magnesium Oxide "I" particles, for instance, are greater than 98% by weight magnesium oxide, have a bulk density of from about 0.15 g/cc to about 0.2 g/cc and have a particle size such that about 98% of the particles pass through a 325 mesh sieve.

In another embodiment, the filler particles contained within the film-forming composition may comprise mica. Mica comprises a group of minerals consisting of hydrous silicates of aluminum or potassium which are common in igneous and metamorphic rocks. Mica is typically found in groups of sheet silicate minerals having a highly perfect basal cleavage. Thus, mica particles when incorporated into a film-forming composition typically have a plate-like shape. Mica has a high dielectric strength and therefore is resistant to heat.

Mica particles are commercially available from numerous sources. For instance, mica particles that are well suited for use in the present disclosure are obtainable from Kaolins de Ploemeur under the trade name MICA MU M2/1. MICA MU M2/1, for instance, has a particle size such that greater than about 50% of the particles have a size less than about 5 microns.

In another embodiment of the present disclosure, the film-forming composition may contain kaolin clay particles. Kaolin clay is generally a hydrous aluminum silicate mineral found in sediments, soils, hydrothermal deposits and sedimentary rocks. Kaolin clay particles can have a plate-like shape typically being found as a layered silicate mineral. Kaolin clay particles typically contain silicon dioxide and aluminum oxide.

Kaolin clay particles are available from numerous commercial sources. For instance, kaolin clay particles can be obtained from Kaolins de Ploemeur under the trade name 7ASP20. 7ASP20 kaolin clay, for instance, has a particle size such that greater than 89% of the particles have a size less than 5 microns and greater than about 64% of the particles have a size less than about 1 micron.

The filler particles as described above, when contained in the film-forming composition, can be combined with any suitable film-forming material. For instance, in one embodiment, the filler particles may be combined with an alginate and a starch as described above. In other embodiments, however, the filler particles may be combined with alginate alone or with starch alone.

Other film-forming materials that may be combined with the filler particles include guar gum, pectin, polyvinyl alcohol, polyvinyl acetate, cellulose, cellulose derivatives such as ethyl cellulose, methyl cellulose, and carboxymethyl cellulose, hydroxypropyl cellulose, hydroxyethyl cellulose, mixtures thereof, and the like.

Prior to application to the wrapper, the film-forming composition containing the filler particles may be water based. Alternatively, the film-forming composition may contain a non-aqueous solvent, such as an alcohol.

Film-forming compositions made according to the present disclosure, including film-forming compositions containing alginate and starch and/or film-forming compositions containing filler particles, can be applied to paper wrappers in discrete areas to form treated areas on the wrapper.

The manner in which the composition is applied to the paper wrapper can vary. For example, the composition can be sprayed, brushed or printed onto the wrapper. To form a treated area, the composition can be applied in a single pass or in a multiple pass operation. For instance, the composition can be applied to the wrapping paper in successive steps in order to form areas on the paper having reduced ignition proclivity. In general, during a multiple pass process, the treated areas can be formed by applying the composition during from about 2 to about 8 passes.

Figure 2:
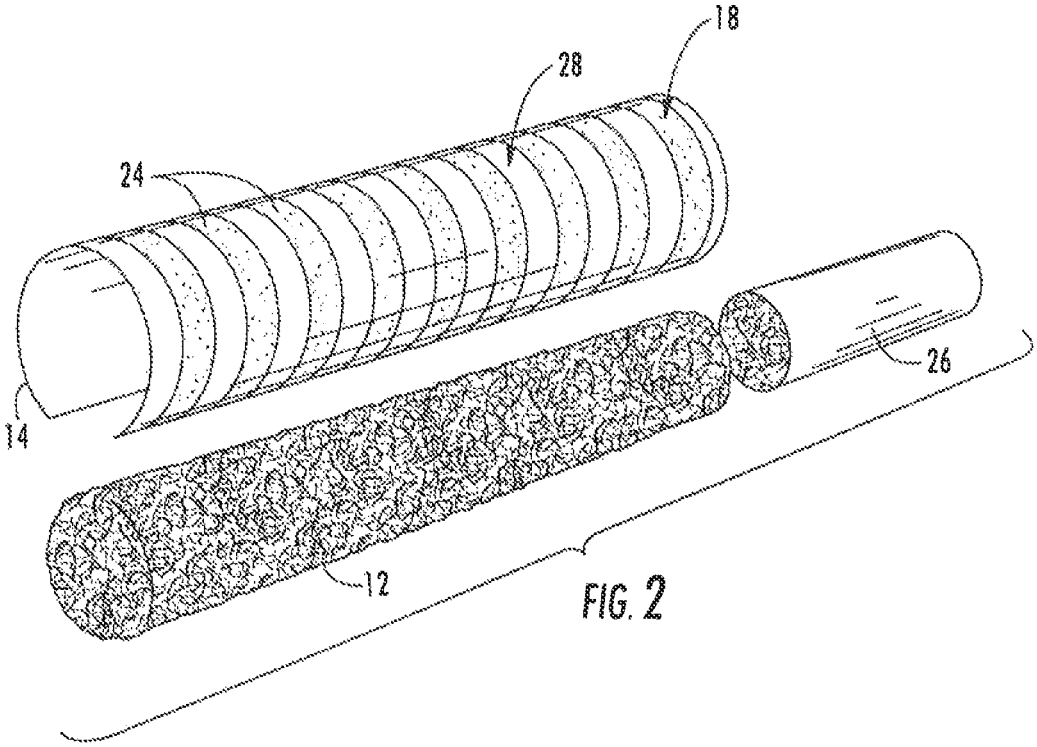
FIG. 2 is an exploded view of the smoking article illustrated in FIG. 1.

In order to assist in describing and explaining the present disclosure, one embodiment is illustrated generally in FIGS. 1 and 2. A smoking article (cigarette), generally 10, having improved ignition proclivity characteristics includes a tobacco column 12 within a wrapper 14. Article 10 may include a filter 26. Wrapper 14 may include any manner of commercially available cigarette wrapper.

Generally, the wrapping paper can be made from cellulosic fibers obtained, for instance, from flax, softwood or hardwood. In order to vary the properties of the paper as desired, various mixtures of cellulosic fibers can be used. The extent to which the fibers are refined can also be varied.

For most applications, the paper wrapper will contain a filler. The filler can be, for instance, calcium carbonate, magnesium oxide, or any other suitable material. The total filler loading added to the paper wrapper can be between about 10% to about 40% by weight.

The permeability of a paper wrapper for smoking articles made according to the present disclosure can generally be from about 10 Coresta units to about 200 Coresta units. In some applications, the permeability can be between about 15 Coresta units to about 55 Coresta units. In one embodiment of the present disclosure, however, the initial permeability of the paper wrapper is relatively high. For instance, in one embodiment, the permeability of the paper wrapper can be from about 60 Coresta units to about 110 Coresta units. In various embodiments, for example the initial permeability of the paper wrapper may be greater than about 70 Coresta units, greater than about 80 Coresta units, greater than about 90 Coresta units, or greater than about 100 Coresta units.

In other embodiments, the initial permeability of the paper wrapper may be less than about 60 Coresta units, such as less than about 50 Coresta units, such as from about 20 Coresta units to about 40 Coresta units.

The basis weight of cigarette wrapping paper is usually between about 18 gsm to about 60 gsm, and more particularly between about 15 gsm to about 40 gsm. Wrapping papers according to the present disclosure can be made within any of these ranges.

In one embodiment, the paper wrapper may be treated with a burn promoting agent. The burn-promoting agent, for example, may be applied over substantially the entire surface area of the wrapping paper, especially over the surface area of the wrapping paper where the treated areas are located including the untreated areas spaced between the treated areas. The burn promoting agent may comprise any suitable substance that enhances the burn rate. Examples of burn promoting agents include alkali metal salts, alkaline earth metal salts, and mixtures thereof. In one embodiment, the burn promoting agent may comprise a salt of a carboxylic acid. In particular examples, for instance, the burn promoting agent may comprise an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, and mixtures thereof. In one particular application, for instance, the burn promoting agent may comprise potassium citrate, sodium citrate, potassium succinate, sodium succinate, or mixtures thereof.

The burn promoting agent may be applied relatively uniformly over the surface area of the paper wrapper in an amount from about 0.3% to over 8% by dry weight, such as from about 0.3% to about 2.5% by dry weight. The burn promoting agent may be applied to the wrapper prior to or after the treated areas are formed on the wrapper using the film forming composition.

The burn promoting agent may be applied to the wrapper for various reasons. For example, the burn promoting agent may be applied so as to further control the burn properties of the wrapper, especially in the untreated areas on the wrapper. The burn promoting agent may also serve as an ash conditioner.

Paper web 14 defines an outer circumferential surface 16 when wrapped around tobacco column 12. Discrete areas 18 of outer circumferential surface 16 are treated with a film-forming composition made in accordance with the present invention, such as an alginate composition blended with a burn promoting agent. It should also be understood that treated areas 18 could also be disposed on the inner surface of wrapper 14. In other words, wrapper 14 could be rolled around tobacco column 12 so that treated areas 18 are adjacent to the tobacco.

In the embodiment illustrated in FIGS. 1 and 2, treated areas 18 are defined as circumferential cross-directional bands 24. Bands 24 are spaced apart from each other longitudinally along the length of cigarette 10. The bands 24 are indicated in phantom in FIG. 2. However, it should be understood that the treated areas are essentially invisible in the formed cigarette as shown in FIG. 1. In other words, a smoker may not discern from any outward sign that the wrapper 14 has been treated in discrete areas 18. In this regard, treated areas 18 have a smooth and flat texture essentially the same as untreated areas 28.

The width and spacing of bands 24 are dependent on a number of variables, such as the initial permeability of wrapper 14, density of tobacco column 12, etc. The bands 24 preferably have a width so that oxygen is limited to the burning coal for a sufficient length or period of time to extinguish the coal. In other words, if band 24 were too narrow, the burning coal would burn through band 24 before self-extinguishing. For most applications, a minimum band width of 3 mm is desired. For example, the band width can be from about 4 mm to about 10 mm.

The spacing between bands 24 is also a factor of a number of variables. The spacing should not be so great that the cigarette burns for a sufficient length of time to ignite a substrate before the coal ever burns into a treated area 18. The spacing between bands 24 also affects the thermal inertia of the burning coal, or the ability of the coal to burn through the treated bands 24 without self-extinguishing. In the cigarettes tested, applicants have found that a band spacing of between 5 and 50 mm is appropriate and particularly between about 10 mm and 40 mm. However, it should be understood that the band spacing can be any suitable width as determined by any number of variables. For most applications, the smoking article can contain from 1 to about 3 bands using the above spacing.

Treated areas 18 have a permeability within a range which is known to provide improved ignition proclivity characteristics for the make-up of cigarette 10. As the coal of cigarette 10 burns into treated areas 18, oxygen available to the burning coal is substantially reduced due to the decreased permeability of wrapper 14 in the treated areas. The reduction of oxygen preferably causes the cigarette to self-extinguish in the treated areas 18 when in contact with a substrate. The permeability, for instance, may be less than 40 $ml/min/cm^2$ (CORESTA), particularly less than 30 $ml/min/cm^2$, and generally within a range of 5 to 25 $ml/min/cm^2$.

Another property of the paper wrapper than can be used to indicate reduced ignition proclivity properties is diffusion capacity. In general, the treated areas 18 according to the present disclosure can have a diffusion capacity of less than about 0.5 cm/s, such than about 0.4 cm/s. For instance, the diffusion capacity can be from about 0 cm/s to about 0.3 cm/s.

Diffusion capacity of the paper wrapper, for instance, can be measured using, for instance, a carbon dioxide diffusion capacity tester that is marketed by SODIM Instrumentation Company.

The above described diffusion capacity ranges are particularly applicable to characterizing treated areas made from a combination of a film-forming material and a polysaccharide. In other embodiments of the present disclosure, such as when a film-forming material is combined with filler particles, the diffusion capacity may be higher than as described above. In particular, the filler particles of the present disclosure when contained in the film-forming composition may reduce the ignition proclivity properties of the paper because the particles are flame retardants. Thus, in some embodiments, the treated areas may have a diffusion capacity of higher than 0.5 cm/s.

The amount of composition that is added to the paper will depend upon various factors, including the type of composition that is used and the desired result. For most applications, the film-forming composition can be added to the paper in an amount from about 1% to about 30% by dry weight of the paper within the banded region, and particularly from about 2% to about 20% by dry weight of the paper within the banded region after the bands have been formed and dried. Although not always the case, generally the amount of the composition applied to the paper will generally increase as the permeability of the paper increases. For instance, for wrapping papers having a permeability of less than about 30 Coresta units, the composition can be applied to a paper in an amount from about 1% to about 20% by weight. For wrapping papers having a permeability greater than about 60 Coresta units, on the other hand, the composition can be applied to the paper in an amount from about 3% to about 30% by weight.

As described above, the composition can be sprayed, brushed, or printed onto the wrapper. In general, any suitable printing process can be used in the present invention. Applicants have found that suitable printing techniques include gravure printing, or flexographic printing.

The present disclosure may be better understood with reference to the following examples.

Example 1

Various paper wrappers were made containing cellulosic fibers in combination with a filler. In this example, the filler comprised calcium carbonate having a medium particle size of 2 microns. The calcium carbonate particles were present in the paper wrapper in an amount of 30% by weight. The wrappers had a basis weight of 27 gsm and a base permeability of 53 Coresta.

Various film-forming compositions were formulated and printed onto the paper wrapper. In particular, the following film-forming compositions were formulated.

1. Aqueous composition containing 1.5% by weight alginate.
2. Aqueous composition containing 10% by weight starch.
3. Aqueous composition containing 11.5% by weight starch.
4. Aqueous composition containing 8% by weight alginate.
5. Aqueous composition containing 11.5% by weight alginate.
6. Aqueous composition containing 1.5% by weight alginate and 10% by weight starch.

In this example, the alginate used was KELGIN LB obtained from International Specialty Products. The starch used was an oxidized starch sold under the trade name FLOKOTE 64 obtained from the National Starch and Chemical Company.

Figure 3:
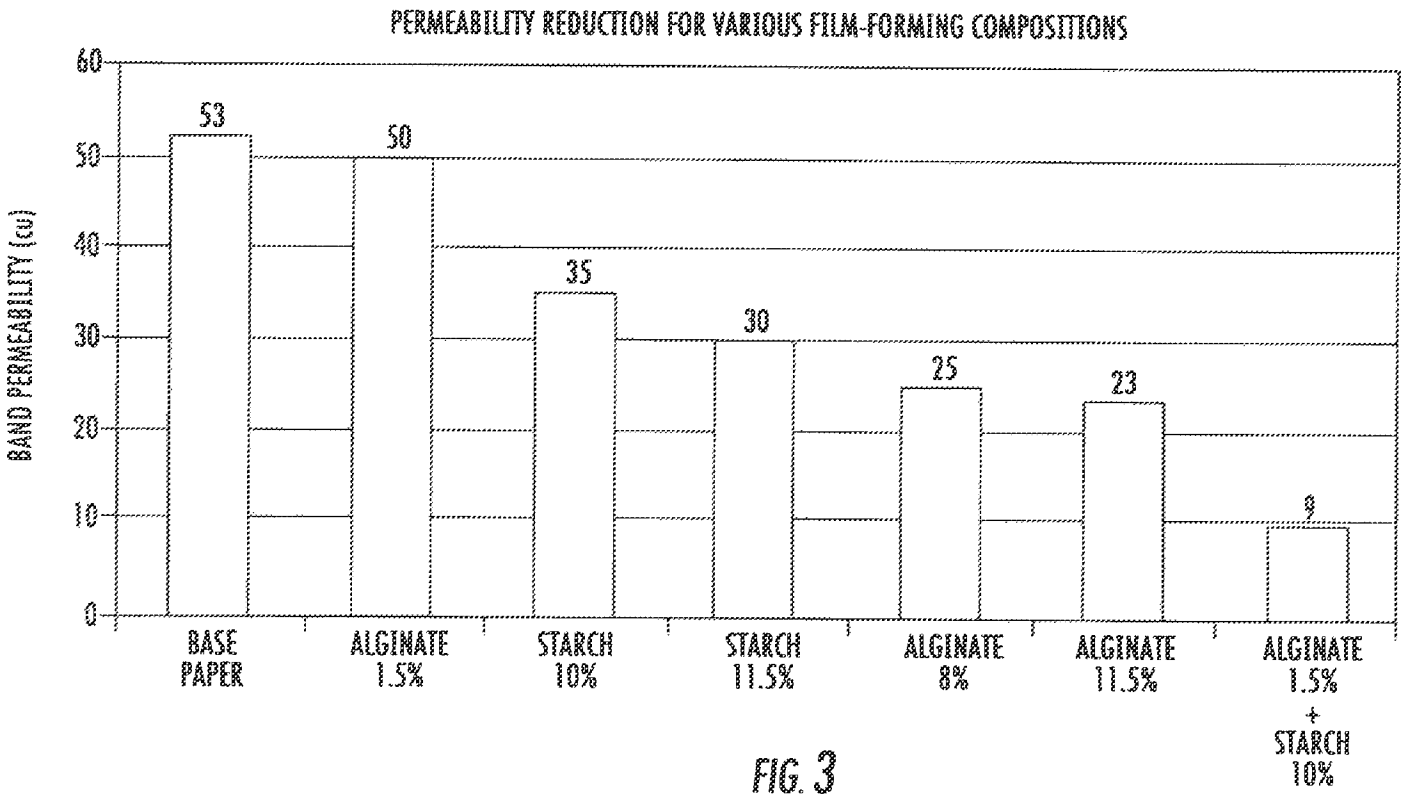
FIGS. 3-8 are graphical representations of the results obtained in the examples that follow.

After the above compositions were applied to the paper wrapper and dried, the permeability within the treated areas was measured and compared to the untreated paper wrapper. The results are shown in FIG. 3. As shown, the combination of alginate and starch was more efficient at reducing the permeability of the paper wrapper in comparison to the other compositions. In each case, the same amount of composition was applied to the paper wrapper.

Example 2

In this example, various film-forming compositions were formulated containing both sodium alginate and an oxidized starch. In particular, the same alginate and starch as described in Example 1 were used.

In one set of tests, the film-forming compositions were applied to a paper wrapper as described in Example 1 having a permeability of 53 Coresta. In a second set of tests, the film-forming compositions were applied to a paper wrapper having a base permeability of 80 Coresta.

Specifically, the following film-forming compositions were formulated:

| SAMPLE NO. | PERCENT BY WEIGHT SODIUM ALGINATE (%) | PERCENT BY WEIGHT OXIDIZED STARCH (%) | VISCOSITY (CPS) |
|---|---|---|---|
| 1 | 3.2 | 15 | 180 |
| 2 | 4.75 | 11.3 | 210 |
| 3 | 6.3 | 7.5 | 270 |

The above film-forming compositions were applied to the paper wrapper using the same process described in Example 1. The following results were obtained:

| RESULTS ON PAPER WRAPPER HAVING A BASE PERMEABILITY OF 53 CORESTA | |
|---|---|
| SAMPLE NO. | PERMEABILITY WITHIN THE TREATED AREAS (CORESTA) |
| 1 | 13 |
| 2 | 13 |
| 3 | 15 |

| RESULTS ON PAPER WRAPPER HAVING A BASE PERMEABILITY OF 80 CORESTA | |
|---|---|
| SAMPLE NO. | PERMEABILITY WITHIN THE TREATED AREAS (CORESTA) |
| 1 | 22 |
| 2 | 22 |
| 3 | 26 |

The 53 Coresta base paper containing Sample No. 3 and the 80 Coresta base paper containing Sample No. 1 were then wrapped around a column of a tobacco filler. The resulting smoking articles were tested according to ASTM Test No. E2187-04 and according to the FASE Test. The following results were obtained:

| BASE PERMEABILITY (CORESTA) | COMPOSITION SAMPLE NO. | FASE SE (%) | ASTM SE (%) |
|---|---|---|---|
| 53 | 3 | 10 | 100 |
| 80 | 1 | 10 | 95 |

As shown above, both of the smoking articles were very effective at self-extinguishing when placed on adjacent surface. Of particular advantage, both smoking articles also had a low FASE rating indicating that smoking articles have a lower tendency to self-extinguish when left in a free-burning state.

Example 3

In this example, various filler particles were added to a sodium alginate film-forming composition and applied to a paper wrapper. In particular, film-forming compositions were made containing kaolin clay particles and magnesium oxide particles. These formulations were then compared with film-forming compositions containing no particles and film-forming compositions containing calcium carbonate particles and talc particles.

In particular, the following filler particles were added to an aqueous solution containing 9.5% by weight sodium alginate. The sodium alginate used in this example was KELGIN LB sodium alginate obtained from International Specialty Products.

| SAMPLE NO. | FILLER PARTICLES | SOLUTION WEIGHT (%) |
|---|---|---|
| 1 | — | — |
| 2 | TALC | 15 |
| 3 | CALCIUM CARBONATE (2 MICRONS) | 15 |
| 4 | CALCIUM CARBONATE (1 MICRON) | 15 |
| 5 | MAGNESIUM OXIDE | 15 |
| 6 | KAOLIN CLAY | 15 |

The above film-forming compositions were applied to the same paper wrappers described in Example 2 above. In particular, the film forming compositions were printed onto a paper wrapper having a base permeability of 53 Coresta and a paper wrapper having a base permeability of 80 Coresta. The permeability within the treated areas was then measured after the film-forming compositions had dried on the paper. The results are illustrated in FIG. 4.

Figure 4:
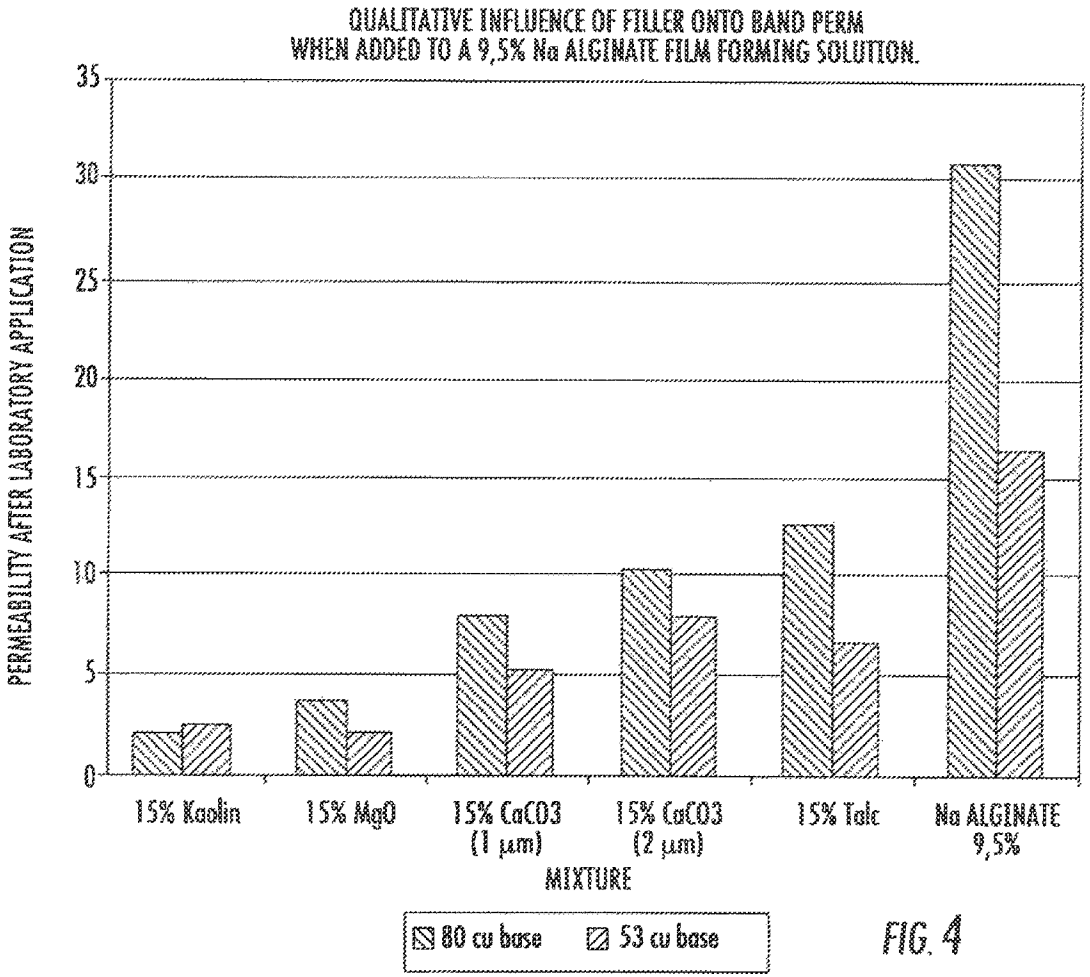

As shown in FIG. 4, kaolin clay particles and magnesium oxide particles unexpectedly reduced the permeability of the wrappers to a much greater extent than the film-forming composition containing no filler particles and in comparison to the film-forming compositions containing talc or calcium carbonate.

In this example, different amounts of the same filler particles were added to a sodium alginate solution and tested.

Specifically kaolin clay particles and magnesium oxide particles were added to a 9.5% by weight sodium alginate composition. The sodium alginate used was KELGIN LB sodium alginate obtained from the International Specialty Products. The following film-forming compositions were formulated.

| SAMPLE NO. | FILLER | WEIGHT (%) |
|---|---|---|
| 1 | NONE | 0 |
| 2 | KAOLIN CLAY | 4 |
| 3 | KAOLIN CLAY | 8 |
| 4 | KAOLIN CLAY | 13 |
| 5 | MAGNESIUM OXIDE | 10 |
| 6 | MAGNESIUM OXIDE | 5 |
| 7 | MAGNESIUM OXIDE | 4 |
| 8 | MAGNESIUM OXIDE | 3 |
| 9 | MAGNESIUM OXIDE | 2 |
| 10 | MAGNESIUM OXIDE | 1 |

The above film-forming compositions were then applied to the 80 Coresta paper wrapper described in the preceding examples. Various tests were then conducted on the compositions and on the paper wrappers. In addition, some of the paper wrappers were made into smoking articles and tested. The results are illustrated in FIGS. 5-8.

Figure 5:
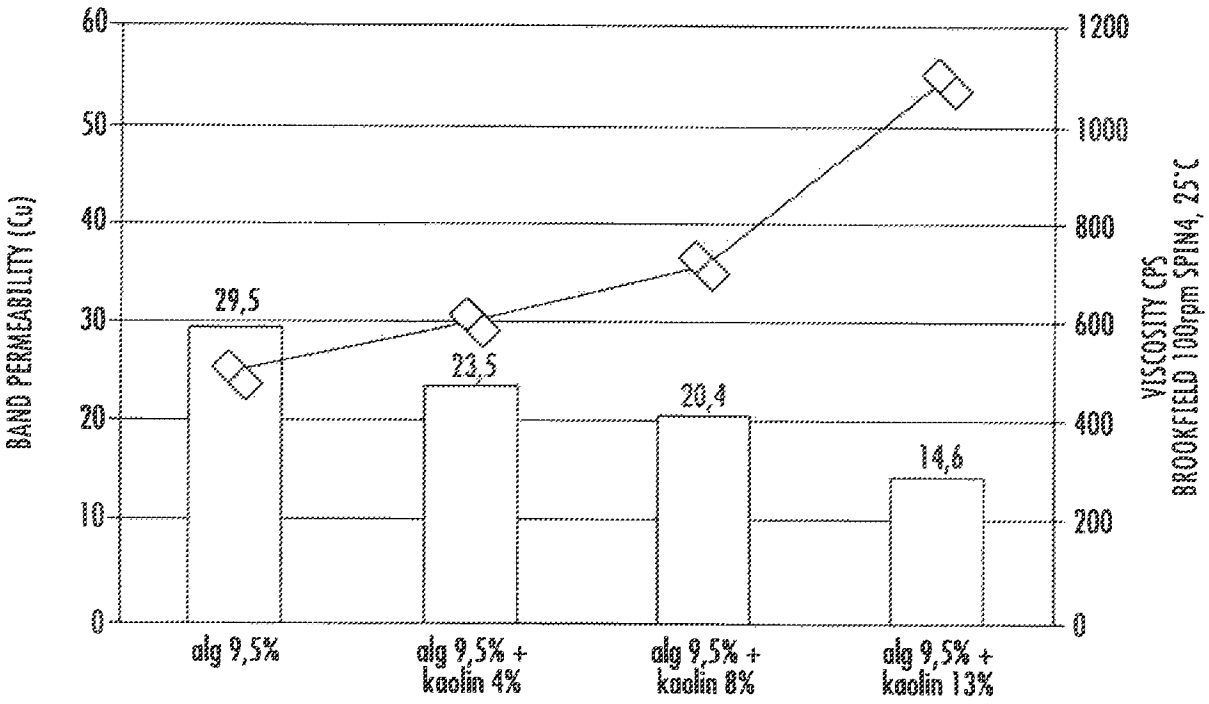

FIG. 5, for instance, shows the permeability within the treated areas for Sample Nos. 1-4 containing the kaolin clay particles. The viscosity of the film-forming compositions was also tested and appears in the graph. As shown, the permeability of the treated areas decreases as the amount of kaolin clay particles increases.

Figure 6:
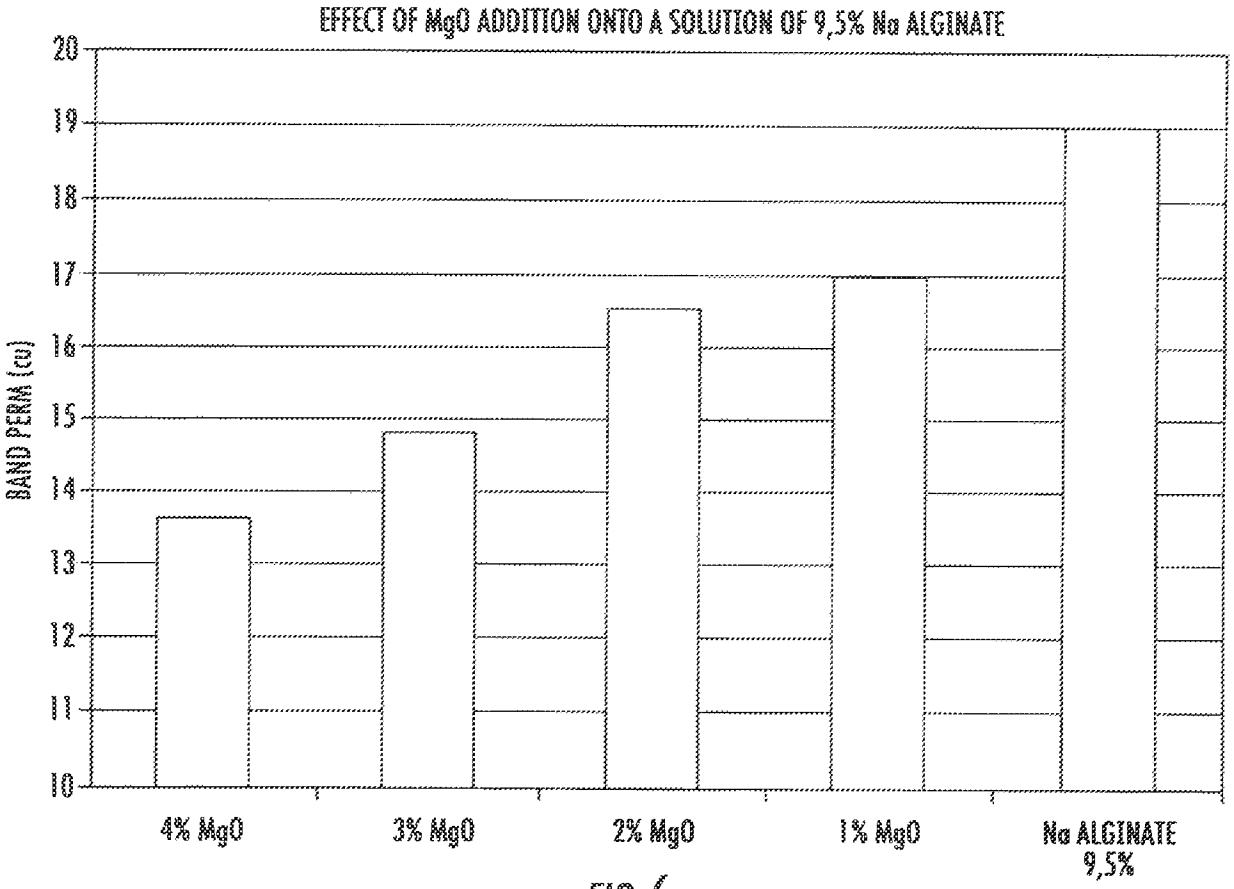

Referring to FIG. 6, the effect of the amount of magnesium oxide in the film-forming composition on the permeability on the treated areas is shown. As illustrated, as the amount of magnesium oxide increases, the permeability of the treated areas decreases. In FIG. 6, the amount of magnesium oxide in the film-forming composition varies from 0 to 4%.

Paper wrappers containing the various amounts of magnesium oxide were then used to construct cigarettes that were tested according to ASTM Test No. E2187-04 and according to the FASE Test. The ASTM Test measures the ability of the treated areas to extinguish the cigarette when left resting on an adjacent surface. A higher number is generally preferred. The EASE Test, on the other hand, evaluates whether or not the cigarette self-extinguishes when left free-burning. Generally, a lower FASE result is preferred but not necessary or critical. For many applications, for instance, ASTM test results can be more important than the FASE results.

Figure 7:
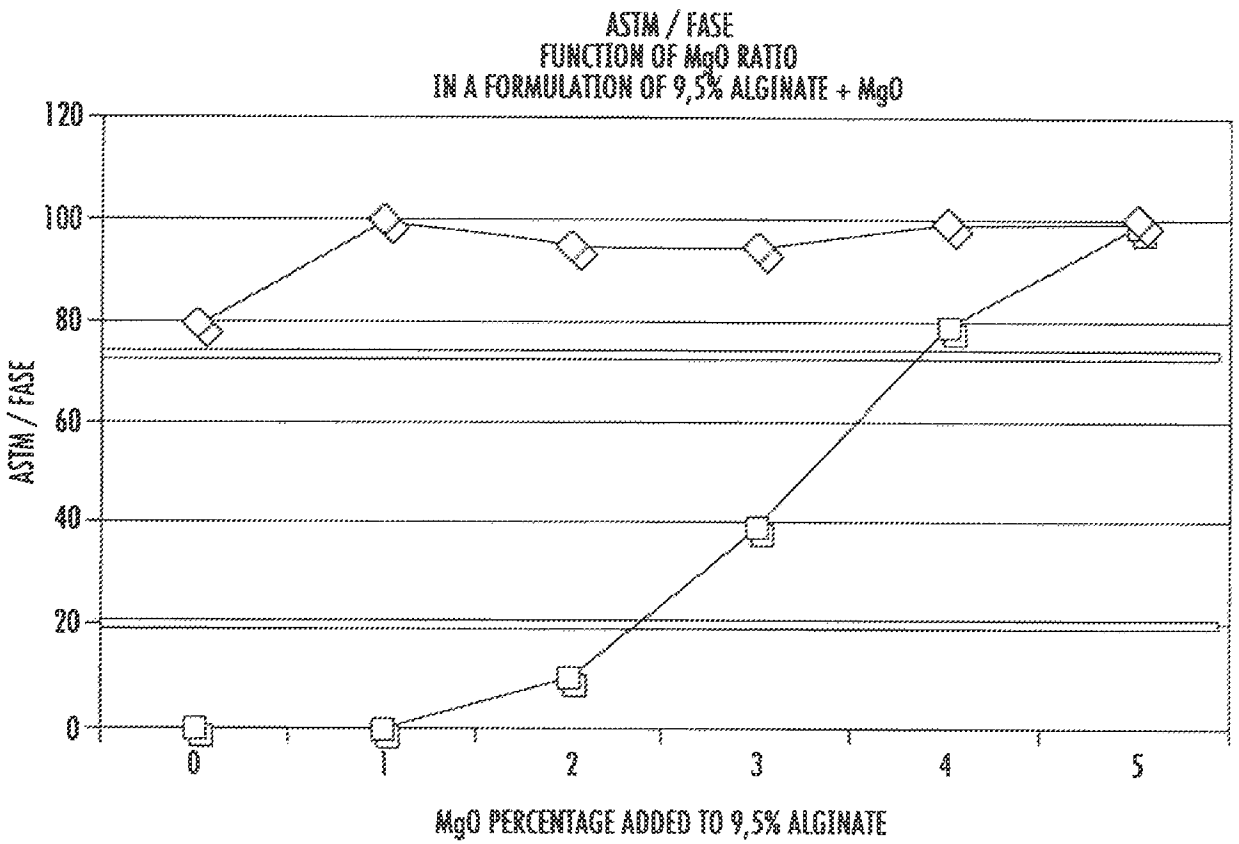

The results of these tests are illustrated in FIG. 7. As shown, the presence of magnesium oxide within the film-forming composition improves the ASTM ranking. Increasing the amount of magnesium oxide within the film-forming composition, however, has a tendency to increase the FASE ranking. As shown, when magnesium oxide particles are present within a film-forming composition containing 9.5% by weight alginate, better FASE results are achieved when magnesium oxide is present in an amount less than about 3% by weight.

Figure 8:
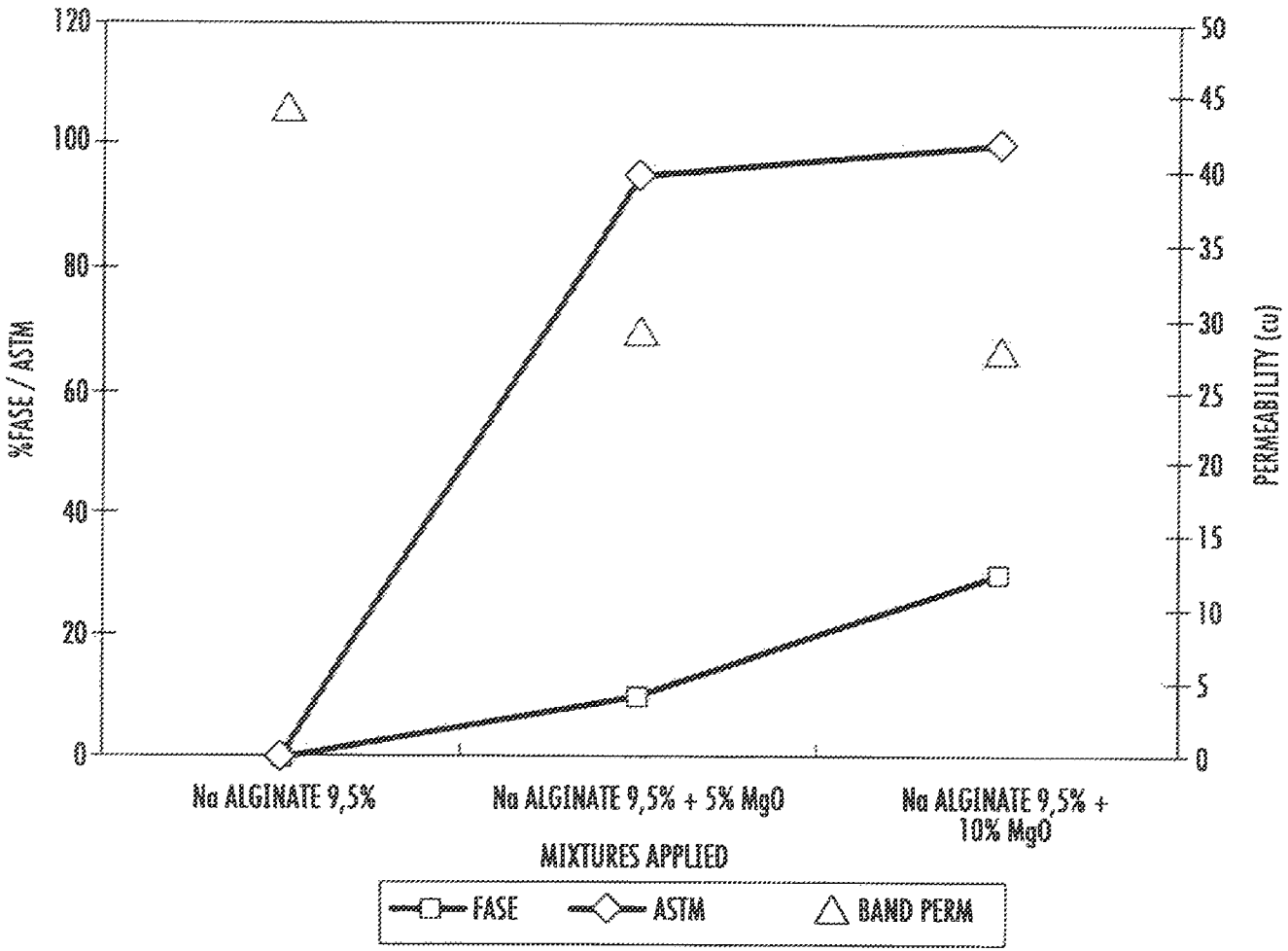

Referring to FIG. 8, further FASE and ASTM results are shown for an alginate composition containing no filler particles, for an alginate composition containing 5% by weight magnesium oxide particles, and for an alginate composition containing 10% by weight magnesium oxide. As shown, the control formulation containing 9.5% alginate did not pass the ASTM Test. It is believed that the permeability of the treated areas was too high.

Example 5

In this example, magnesium oxide particles were added to an oxidized starch solution and applied to a paper wrapper with a base permeability of 60 Coresta.

Specifically 3% by weight magnesium oxide particles were added to a 22% by weight starch composition. The starch used was an oxidized starch sold under the trade name FLOKOTE 64 obtained from the National Starch and Chemical Company.

The solution was then applied to a paper web in bands, dried, and tested for permeability. The resulting band permeability was 6 Coresta.

The treated paper was then wrapped around a column of a tobacco filler. The resulting smoking article was tested according to ASTM Test No. E2187-04 and according to the FASE Test. The following results were obtained:

| BASE PERMEABILITY (CORESTA) | ASTM SE (%) | FASE SE (%) |
|---|---|---|
| 60 | 98 | 42 |

As shown above, the smoking article was very effective at self-extinguishing when placed on adjacent surface.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A process for producing a paper wrapper having reduced ignition proclivity characteristics when incorporated into a smoking article, the process comprising:

applying a film-forming composition to the paper wrapper, the film-forming composition forming discrete treated areas on the paper wrapper, the discrete treated areas being separated by untreated areas, the film-forming composition comprising an alginate and a starch, wherein the starch is present in the treated areas in an amount of from about 1% to about 20% by dry weight of the treated area, and the alginate is present in the treated area in an amount of less than about 15% by dry weight of the treated area, wherein the starch is present in the treated areas in an amount greater than an amount of the alginate, the treated areas reducing the ignition proclivity of the smoking article incorporating the paper wrapper, the treated areas having a permeability of about 13 Coresta or greater and having a permeability of less than about 40 Coresta, the treated areas having a diffusion capacity of less than about 0.4 cm/s.

2. The process as defined in claim 1, wherein the alginate is present in the film-forming composition in an amount from about 1% to about 15% by weight and the starch is present in the film-forming composition in an amount from about 3% to about 25% by weight.

3. The process as defined in claim 1, wherein the alginate comprises a sodium alginate.

4. The process as defined in claim 1, wherein the starch comprises an oxidized starch.

5. The process as defined in claim 1, wherein the film-forming composition comprises an aqueous composition.

6. The process as defined in claim 1, wherein the film-forming composition further comprises filler particles.

7. The process as defined in claim 6, wherein the filler particles comprise magnesium oxide, mica, kaolin clay, or mixtures thereof.

8. The process as defined in claim 1, further comprising applying a burn promoting agent to the paper wrapper.

9. The process as defined in claim 8, wherein the burn promoting agent is applied uniformly over substantially the entire surface area of the paper wrapper.

10. The process as defined in claim 8, wherein the burn promoting agent comprises an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, or mixtures thereof.

11. The process as defined in claim 1, wherein the treated areas form a plurality of discrete circumferential bands disposed longitudinally along the paper wrapper.

12. The process as defined in claim 11, wherein the bands are spaced from each other at a distance of from about 5 mm to about 50 mm and the bands have a width of greater than about 3 mm.

13. The process as defined in claim 1, wherein the treated areas are printed onto the paper wrapper.

14. The process as defined in claim 1, wherein the treated areas have a diffusion capacity of less than about 0.5 cm/s.

15. The process as defined in claim 1, wherein the treated areas have a permeability of less than about 30 Coresta.

16. The process as defined in claim 1, wherein the paper wrapper has a basis weight of from about 18 gsm to about 60 gsm.

17. The process as defined in claim 1, wherein the untreated areas have a permeability of greater than about 80 Coresta.

18. The process as defined in claim 1, wherein the film-forming composition consists of either the alginate and the starch, or the alginate, the starch, and a filler particle.

19. The process as defined in claim 1, wherein the permeability and the diffusion capacity of the paper wrapper are lowered by the film-forming composition as compared to treating the paper wrapper with a solution containing equal or greater amounts of only the alginate or only the starch as compared to the amounts of the alginate and starch contained in the film-forming combination.

20. The process as defined in claim 1, wherein the film-forming composition of the alginate and starch has improved printability as compared to solutions of only the alginate or a solution of only the starch, wherein the composition has a viscosity of less than 1500 cps.

21. A process for producing a paper wrapper having reduced ignition proclivity characteristics when incorporated into a smoking article, the process comprising:

applying a film-forming composition to the paper wrapper, the film-forming composition forming discrete treated areas on the paper wrapper, the discrete treated areas being separated by untreated areas, the film-forming composition comprising an alginate and a starch, the alginate being present in the film-forming composition in an amount of less than about 15% by weight and the starch is present in the film-forming composition in an amount from about 3% to about 25% by weight, wherein the starch is present in the treated areas in an amount greater than the alginate, the treated areas reducing the ignition proclivity of the smoking article incorporating the paper wrapper, the treated areas having a permeability of about 13 Coresta or greater and less than about 30 Coresta and a diffusion capacity of less than about 0.4 cm/s, the paper web having a basis weight of from about 18 gsm to about 60 gsm.

22. The process as defined in claim 1, wherein the alginate comprises a sodium alginate and the starch comprises an oxidized starch.

23. The process as defined in claim 1, wherein the paper web has a basis weight of from 18 gsm to 60 gsm, the paper web having an initial permeability of from 20 Coresta to 150 Coresta, the film-forming composition being applied to the paper wrapper in an amount from 1% to 30% by dry weight based upon the weight of the wrapper within the treated areas.

24. The process as defined in claim 23, wherein the treated areas are in the shape of circumferential bands having a width of from 4 mm to 10 mm and being spaced from each other a distance of from 5 mm to 50 mm.

25. The process as defined in claim 24, wherein the film-forming composition is applied to the paper wrapper by being printed onto the paper wrapper.

* * * * *